US008459347B2

(12) United States Patent
Stout

(10) Patent No.: US 8,459,347 B2
(45) Date of Patent: Jun. 11, 2013

(54) SUBTERRANEAN WELL ULTRA-SHORT SLIP AND PACKING ELEMENT SYSTEM

(75) Inventor: Gregg W. Stout, Montgomery, TX (US)

(73) Assignee: Oiltool Engineering Services, Inc., Willis, TX (US)

( * ) Notice: Subject to any disclaimer, the term of this patent is extended or adjusted under 35 U.S.C. 154(b) by 390 days.

(21) Appl. No.: 12/653,155

(22) Filed: Dec. 9, 2009

(65) Prior Publication Data

US 2010/0139911 A1 Jun. 10, 2010

Related U.S. Application Data

(60) Provisional application No. 61/201,444, filed on Dec. 10, 2008.

(51) Int. Cl.
*E21B 33/129* (2006.01)
*E21B 23/06* (2006.01)

(52) U.S. Cl.
USPC ..... 166/138; 166/217; 166/387

(58) Field of Classification Search
USPC ..... 166/134, 217, 387, 118, 133, 135, 166/137, 138, 188
See application file for complete search history.

(56) References Cited

U.S. PATENT DOCUMENTS 2,217,747 A * 10/1940 Henderson ..... 166/126
2,241,561 A 5/1941 Spencer
2,331,532 A * 10/1943 Bassinger ..... 166/139
2,672,199 A * 3/1954 McKenna ..... 277/335
2,714,932 A * 8/1955 Thompson ..... 166/119
2,715,441 A * 8/1955 Bouvier ..... 166/127
2,822,874 A * 2/1958 Brown ..... 166/119
3,000,443 A * 9/1961 Thompson ..... 166/135
3,142,338 A * 7/1964 Brown ..... 166/120
3,160,209 A * 12/1964 Bonner ..... 166/63
3,303,885 A * 2/1967 Kisling, III ..... 166/134
3,467,186 A * 9/1969 Current ..... 166/216
3,845,816 A * 11/1974 Pitts ..... 166/120
3,910,348 A * 10/1975 Pitts ..... 166/134
4,022,274 A * 5/1977 Jett ..... 166/118
4,083,408 A * 4/1978 Milam ..... 166/387
4,429,741 A * 2/1984 Hyland ..... 166/63
4,595,052 A * 6/1986 Kristiansen ..... 166/123
4,600,058 A * 7/1986 Van Wormer et al. ..... 166/382
4,708,202 A * 11/1987 Sukup et al. ..... 166/123
4,749,047 A * 6/1988 Taylor ..... 166/382
4,784,226 A * 11/1988 Wyatt ..... 166/376
5,086,839 A * 2/1992 Setterberg et al. ..... 166/138
5,542,473 A * 8/1996 Pringle ..... 166/120

(Continued)

OTHER PUBLICATIONS

USPTO Office Action (Non-Final); Dec. 9, 2012, pp. 1-16.

*Primary Examiner* — Jennifer H Gay
(74) *Attorney, Agent, or Firm* — John J. Love; Cooke Law Firm

(57) ABSTRACT

A subterranean well tool seals along a section of a wall of the well and is carried on a conduit into the well. A plurality of anchoring elements and seals are provided for respective anchoring and sealing engagement along the wall of the well in concert and substantially concurrently with one another when the tool is shifted to the set position. When the well tool moves to the set position, a portion of the mandrel separates and is retrieved from the well bore, allowing the well tool to be reduced in overall length. The anchoring elements are sandwiched in between first and second, or upper and lower, sets of seals.

9 Claims, 8 Drawing Sheets

U.S. PATENT DOCUMENTS

| | | | | |
|---|---|---|---|---|
| 5,564,502 | A * | 10/1996 | Crow et al. | 166/386 |
| 5,924,696 | A * | 7/1999 | Frazier | 277/336 |
| 6,257,331 | B1 * | 7/2001 | Blount et al. | 166/125 |
| 6,276,690 | B1 * | 8/2001 | Gazewood | 277/336 |
| 6,302,217 | B1 * | 10/2001 | Kilgore et al. | 166/382 |
| 6,318,459 | B1 * | 11/2001 | Wright et al. | 166/117.6 |
| 6,467,540 | B1 * | 10/2002 | Weinig et al. | 166/120 |
| 6,513,600 | B2 * | 2/2003 | Ross | 166/387 |
| 6,619,391 | B2 * | 9/2003 | Weinig et al. | 166/120 |
| 6,666,276 | B1 * | 12/2003 | Yokley et al. | 166/387 |
| 7,017,672 | B2 * | 3/2006 | Owen, Sr. | 166/387 |
| RE39,209 | E * | 8/2006 | Barton | 166/317 |
| 7,134,504 | B2 * | 11/2006 | Doane et al. | 166/387 |
| 7,159,668 | B2 * | 1/2007 | Herrera | 166/381 |
| 7,165,622 | B2 * | 1/2007 | Hirth et al. | 166/387 |
| 7,225,867 | B2 * | 6/2007 | Mackenzie et al. | 166/250.08 |
| 7,552,778 | B2 * | 6/2009 | Slack | 166/383 |
| 7,665,537 | B2 * | 2/2010 | Patel et al. | 166/387 |
| 7,669,665 | B2 * | 3/2010 | Millet et al. | 166/382 |
| 7,762,323 | B2 | 7/2010 | Frazier | |
| 7,779,905 | B2 * | 8/2010 | Carisella et al. | 166/134 |
| 8,191,645 | B2 * | 6/2012 | Carisella et al. | 166/387 |
| 8,307,892 | B2 * | 11/2012 | Frazier | 166/135 |
| 2004/0045723 | A1 * | 3/2004 | Slup et al. | 166/386 |
| 2004/0216868 | A1 * | 11/2004 | Owen, Sr. | 166/134 |
| 2006/0243457 | A1 * | 11/2006 | Kossa et al. | 166/387 |
| 2006/0272828 | A1 * | 12/2006 | Manson | 166/387 |
| 2008/0202771 | A1 * | 8/2008 | Carisella et al. | 166/387 |
| 2010/0314135 | A1 * | 12/2010 | Carisella et al. | 166/387 |
| 2011/0290473 | A1 * | 12/2011 | Frazier | 166/135 |
| 2012/0006532 | A1 * | 1/2012 | Frazier | 166/196 |
| 2012/0118561 | A1 * | 5/2012 | Frazier | 166/135 |

* cited by examiner

SUBTERRANEAN WELL ULTRA-SHORT SLIP AND PACKING ELEMENT SYSTEM

CROSS-REFERENCE TO RELATED APPLICATION

This application is the formal patent application for provisional application Ser. No. 61/201,444, filed Dec. 10, 2008, entitled "Ultra-short Slip and Packing Element System". Applicant hereby claims priority from said application.

BACKGROUND OF THE INVENTION

1. Field of the Invention

This invention relates to downhole tools for oil and gas wells and similar applications and more particularly to improved well packers, plugs, and the like.

2. Description of Prior Art

Well packers are used to form an annular barrier between well tubing or casing, to create fluid barriers, or plugs, within tubing or casing, or the control or direct fluid within tubing or casing. Packers may be used to protect tubulars from well pressures, protect tubulars from corrosive fluids or gases, provide zonal isolation, or direct acid and frac slurries into formations.

Typical well packers, bridge plugs, and the like, consist of a packer body. Radially mounted on the packer body is a locking or release mechanism, a packing element system, and a slip system. These packers tend to be two feet or longer depending on the packer design. The packing system is typically an elastomeric packing element with various types of backup devices. The packing system is typically expanded outward to contact the I.D. (internal diameter) of the casing by a longitudinal compression force generated by a setting tool or hydraulic piston. This force expands the elastomer and backups to create a seal between the packer body and casing I.D. This same longitudinal force acts through the sealing system and acts on the slip system. The slip system is typically an upper and lower cone that slides under slip segments and expands the slip segments outwardly until teeth on the O.D. (outer diameter) of a series of slip segments engage the I.D. of the casing. Teeth or buttons on the O.D. of the slip segments penetrate the I.D. of the casing, to secure the packer in the casing, so the packer will not move up or down as pressure above or below the packer is applied. A locking system typically secures the seal and slip systems in there outward engaged position in order to maintain compression force in the elastomer and, in turn, compression force on the slip system. Certain part configurations allow the locking mechanism to disengage to allow retrieval of the packer. The presence of the release mechanism usually classifies the packer as a "retrievable packer" and the absence of the release mechanism classifies the packer as a "permanent packer".

Problems with prior art packers, in some cases, can be the excessive length of the packers since all of the above combined systems require length. An increased length of the tool results in an increased effort to mill or drill out the tool if and when necessary, particularly at the end of the useful life of the tool. It would advantageous to have a packer that is much shorter in that reduced material would certainly lower material and manufacturing costs. It would be advantageous to have a very short packer, so if packer removal is required, milling time would be greatly reduced.

Some of the drillable frac plugs on the market are the Halliburton "Obsidian Frac Plug", the Smith Services "D2 Bridge Plug", the Owen Type "A" Frac Plug, the Weatherford "FracGuard", and the BJ Services "Phython". By comparison, all of these plug designs are very long in comparison to the current invention. Also, a very short packer would reduce cost and simplify the task of creating a "Pass-through" packer. "Pass-through" packers are used for intelligent well completions and allow the passage of, for example and not limited to, hydraulic control lines, fiber optic lines, and electrical lines.

Both retrievable and permanent packers are sometimes drilled or milled out of the casing. If the packer is being used as a "Frac Plug", it is commonly milled out after the frac is completed. Typical packers, as described above, tend to have mill-out problems because the packer parts tend to spin within the engaged slips. The mill operation becomes very inefficient because the packer parts spin with the rotation of the milling tool. Some packer designs exist, for example the BJ Services U.S. Pat. No. 6,708,770, to reduce this spinning tendency. It would be advantageous to have a packer design that would offer alternative features to prevent spinning of parts while milling out. It would also be advantageous if this same design feature would provide a means to equally distribute the slip segments around the packer body to evenly distribute the load on the I.D. of the casing, and also function as packer retrieval devices to retain and retract the slip segments during retrieving.

Another problem is that the slip system is loaded through the packing element system. Any degradation or extrusion of the packing element system reduces stored energy in the slip system thus allowing the slip system to disengage, especially during pressure reversals, the casing and in turn cause packer slippage and seal failure.

Typical packers have a seal system that has elastomers backed up by anti-extrusion devices and the anti-extrusion devices are backed up by gage rings. The gage rings typically have a built-in extrusion gap between the O.D. of the gage ring and the I.D. of the casing to provide running clearance for the packer. The built-in extrusion gap can be a problem and is commonly the primary mode of seal system failure at higher temperatures and pressures. This is because the elastomers and backup devices tend to move into the extrusion gaps. When this movement occurs, the stored energy is lost in the seal system and the seal engagement is jeopardized to the point of seal failure. It would be an advantage to remove the majority of the extrusion gap to prevent the seal from extruding or moving. Attempts have been made to reduce the extrusion gap by use of expandable metal packers, for example, the Baker expandable packer U.S. Pat. No. 7,134,504 B2, US 2005/0217869, and U.S. Pat. No. 6,959,759 B2, or the Weatherford Lamb metal sealing element patent #US 2005/023100 A1.

Typical retrievable packers have slip systems that, when expanded, contact the I.D. of the casing at 45 degree or 60 degree increments around the I.D. of the casing. Each slip segment has a width and there is typically a space between each slip segment. The space between each slip segment creates a surface area where no slip tooth engagement occurs. The total slip contact with the I.D. of the casing may, for example, only be 50% of the surface area on the inside of the casing. If pressure is applied across the packer, the slips are driven outward into the casing. It is a problem in that due to the incremental contact on the I.D. of the casing, high non-uniform stresses in the casing wall can cause deformation or even failure of the casing wall. It would be very desirable to have a slip system that approaches a full 360 degree contact in the I.D. of the casing to minimize damage to the casing. Also, with slip engagement approaching 360 degrees, there is more slip tooth engagement due to increased radial surface contact area, thereby providing the opportunity to reduce length of the slip. Reduced length of the slip then reduces the overall length of the packer.

Typical permanent packers have slip systems that "break". Slips that "break" approach the 360 degrees of contact. These slips are usually made by manufacturing a ring, cutting slots in the ring to create break points, and then treating the teeth on the O.D. of the ring for hardness purposes. When longitudinal load is applied to a cone, the cone moves under the slip ring and the ring tends to break at the slots to create slip segments. History has shown that the slip segments, break unevenly or don't break at all, break at different forces, and engage the I.D. of the casing in irregular patterns. These breaking problems can reduce the performance and reliability of the packer. It would be advantageous to have slips that approach the 360 degrees of contact and are not required to break, don't require a variable force to break, and evenly distribute themselves around the I.D. of the casing.

Some packers have built-in "boosting" systems. Boosting systems exert additional force on packer seal systems when differential pressure is applied from either above or below, or both, relative to the packer. The additional boosting force tends to help the packer maintain a seal with the I.D. of the casing. The boosting systems typically added to packers require additional parts that add complexity to the packer and require the use of additional seals. Additional seals increase the risk of packer leaks if the seal should fail.

It would be advantageous to have a packer slip/seal design that inherently provides a seal and slip boosting feature, without additional seals and parts, when pressure is applied from either above or below the packer and in which design the slips and seals are arranged in a manner to provide sufficient well sealing and anchoring with component parts which are considerably shorter than those found in conventional packers and similar well plugs.

SUMMARY OF THE INVENTION

A tool is provided for sealing along a section of a wall of a subterranean well. The wall may be uncased hole or the internal diameter wall of set casing inside the well. The tool is carriable into said well on a conduit. The conduit may be any one of a number of conventional and well known devices, such as tubing, coiled tubing, wire line, electric line, and the like, and moveable from a run-in position to a set position by a setting tool manipulatable on or by said conduit. The tool comprises a plurality of anchoring elements, sometimes referred to as slips with a set of profiled angularly positioned teeth around the exterior for biting engagement into the wall of the well upon setting of the tool. The tool is shiftable from a first retracted position when the well tool is in a run-in position to a second expanded position after manipulation of the setting tool. The tool also includes seal means, preferably made of an elastomeric material, but may be metallic, or a combination thereof, which are carried around the anchoring elements for sealing engagement along the wall of the well in concert and substantially concurrently with the anchoring elements when the anchoring elements are shifted to the set position.

Stated somewhat differently, the tool of the present invention provides a packer device including an interior packer body and radially surrounding cone, slip and seal system that seals and engages the surrounding casing or other tubular member. The cones expand both the seal system and the slip system simultaneously. The slip system provides a means for supporting the seal system when pressure is applied from above or below the packer. The close proximity of the seal and slip system provides for a very short packer or a "minimum material packer" that offers lower cost, higher performance, and if required, faster mill-out.

The seal system can be of several configurations and one such configuration is an expandable metal seal combined with an optional elastomeric or non-elastomeric seal for high temperature and pressure applications.

This invention also provides an improved packer for cased or uncased wells or for a tubular member positioned inside of casing. A very short and simple packer design, with features that increase overall packer reliability, is created by effectively combining synergies of the cone, slip and seal elements to work in unison.

This packer can be set on standard or electric wireline, or with hydraulic setting tools conveyed on jointed pipe or coiled tubing.

The packer can be ready modified to serve several applications. A hydraulic setting cylinder can be added so the packer can be run as part of the casing or tubing. The packer can utilize a fixed frangible disc or a flapper device to serve as a bridge plug, frac plug, or frac disc-type of component.

The materials of the packer can be optimized to reduce mill-out time. Mill-out time is greatly reduced due to the very short length of the packer, typically, 3" to 4", so expensive composite materials aren't necessarily required, 3) a seal bore can easily be attached to the packer body. Since the slip system creates a metal-to-metal interface with the I.D. of the casing, the packer can readily be adapted to a high pressure and temperature well environment. The packer can address applications as simple as low cost plug and abandonment to highly complex applications in hostile environment wells. Finally, the packer, due to it's short length, is ideal for incorporating "control line pass-thru" for intelligent well completions.

DETAILED DESCRIPTION OF THE PREFERRED EMBODIMENTS

Figure 1:
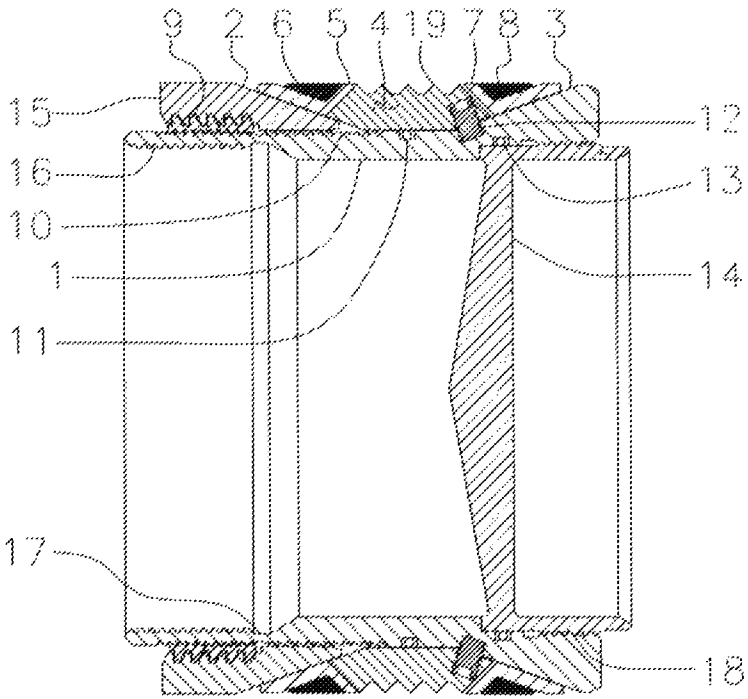
FIG. 1 is a schematic view of the present invention in the "running position".

With reference to FIG. 1, a schematic of the present invention shows a 180 degree cross-section of the packer. A mandrel 1 has a running thread 16 with a separation recess 17 immediately below the running thread. Seal 11 is located on the O.D. of the mandrel 1. At the bottom of the mandrel are an internal thread 18 and a seal 13. A setting tool (not shown) is made up to running thread 16 in order to convey the packer into the well. A millable, frangible or disintegrable disc 14 is a fluid barrier and is threaded into thread 18 and seals on seal 13. Cone surface 3 is shown of the O.D. of the mandrel 1.

Lower seals 7 and 8 are shown to be positioned on cone surface 3. Seal portion 7 is a deformable material but has sufficient rigidity to bridge the gap between slip segments 4. Seal portion 8 is a deformable seal material that is fixably attached to seal portion 7 so that it can be reliably transported into the well. Rotational lock pin 12 is either attached to, or part of, mandrel 1. The number of rotational pins is equal to the number of gaps between slip segments 4. The rotational pins assist in positioning the slip segments equally around the mandrel and a modified version can act as a pickup shoulder if used in a retrievable packer configuration. The slip segments 4 are positioned almost 360 degrees around the O.D. of the mandrel 1. Each slip segment has a series of teeth 19, or some other casing penetrating profile, on the O.D. of the slip segment. The teeth are sufficiently hard to penetrate the inside of the casing wall in order to grip the wall and prevent the packer from moving relative to the casing. The slip segments have an O.D. that is machined to be almost equal to the I.D. of the casing. The slip segments are machined to minimize any gaps between the O.D. of the slip segments and the I.D. of the casing. Similarly, the angles on the I.D. of the slip segments are machined to almost match the O.D. of the cone surfaces 2 and 3 when the slip is fully expanded, in order to minimize gaps between the parts.

Seal 11 does not seal in the "running position" but in the "set position" seals on the I.D. of upper cone 15. Upper seals 5 and 6 are the same as seals 7 and 8. These seals, of course, can assume different geometries and materials based on the application of the packer. Upper and lower seals, 5,6,7,8, are of sufficient strength to capture and retain slip segments 4 inward during the trip into the well.

Upper cone 2 has a surface 15. The setting tool (not shown) pushes against surface 15 while pulling on threads 16 during the setting operation. Upper cone 2 has internal thread that engage body lock ring 9. Body lock ring 9 can ratchet freely toward the slip segments 4 but engages and prevents movement away from the slip segments 4 by engaging the threads on the top O.D. of the mandrel 2.

Figure 2:
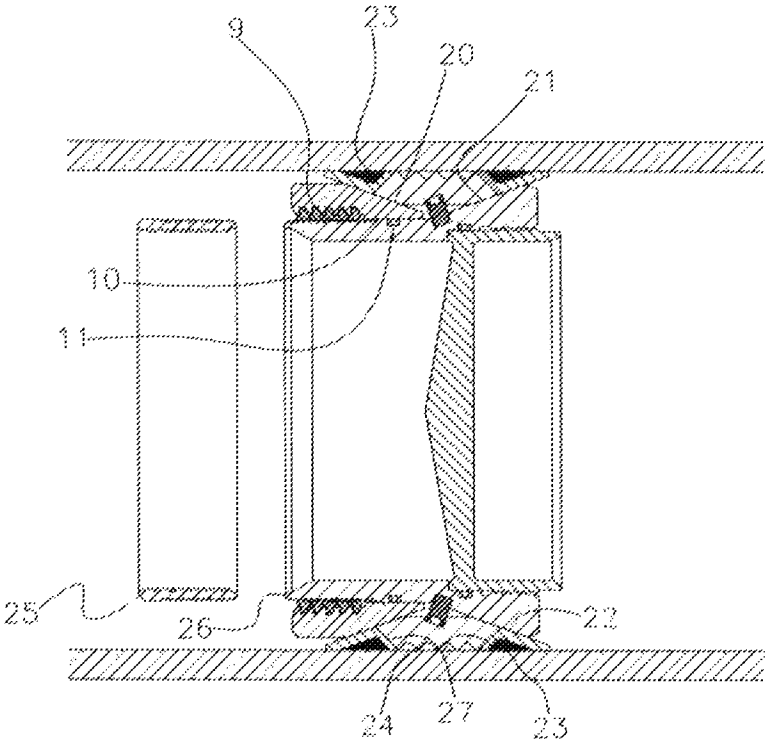
FIG. 2 is a schematic view of the present invention in the "set position".

FIG. 2 shows the packer in the "set position". In operation, the setting tool (not shown) pushes on surface 15 and pulls on thread 16. Upper cone 2 moves toward the slip segments 4 and in the process expands the slip segments 4 and the deformable seals 5, 6, 7, and 8. Expansion continues until sufficient contact is made with the I.D. of the casing to achieve slip tooth 19 penetration in the inner wall of the casing. At this point the teeth of the slip segments have nearly closed any seal extrusion gaps between the O.D. of the slip segments and the I.D. of the casing. Extrusion gaps have been minimized nearly 360 degrees around the packer. Additionally, slip load has been nearly evenly distributed around the I.D. of the casing to minimize distortion of the casing. Slip segment 4 distribution around the O.D. of the mandrel 1 is more uniform due to the pins 12. Also, extrusion gaps have been closed where the I.D. of the slip segments contact the surfaces of the cones at 20 and 21. At his point the only extrusion gaps that exist are the ones between the slip segments. This can be seen in FIG. 3 identified as 31. These extrusion gaps are blocked with the seal portions 5 and 6 that additionally minimize extrusion of seal portions 6 and 8. The seals portions are expanded with the cones until surface 23 makes sufficient sealing contact with the I.D. of the casing. At this point the upper and lower cones have simultaneously engaged the slips and expanded the seals. Sufficient force is placed on the slips and cones to achieve tooth penetration and store seal compression. As a result, loss of seal compression does not create loss of slip tooth engagement and vise-versa. Furthermore, in the set position, all extrusion gaps have been closed to a minimum.

As the setting tool continues to stroke, body lock ring 9 ratchets on mandrel 1 until the slip segments and seals are fully energized. Lock ring 9 will not allow reverse movement to occur; therefore the packer is locked in the "set position". In the FIG. 2 packer configuration, the setting tool continues to add force to the packer until a pre-planned tensile load is reached. This load is sufficient to shear the mandrel 1 at recess 17 so that ring 25 separates from mandrel 1. Removal of ring 25 leaves a minimum amount of material to aid any milling operations that may be planned. Other methods of separation from the mandrel 1 are available depending on the application of the packer.

In the set position, FIG. 2, when pressure is applied from below the packer, the cone surface 3 acts on the seal 7 and 8 and the slip segment 4 to further energize tooth engagement and the seals. Pressure from below acts on seals 7 and 8 to achieve a better seal. Conversely, pressure from above acts on seals 5 and 6 and cone surface 2 to achieve a better tooth engagement and seal pack-off.

Figure 3:
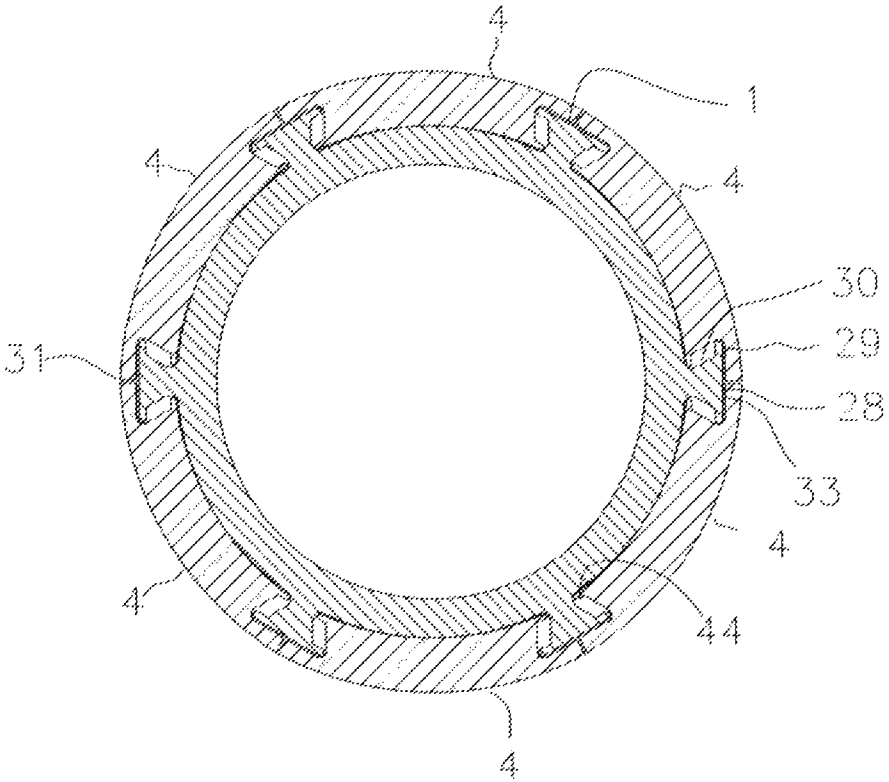
FIG. 3 is a cross-sectional view of the packer mandrel and slip segments of the present invention in the fully expanded "set position".
Figure 4:
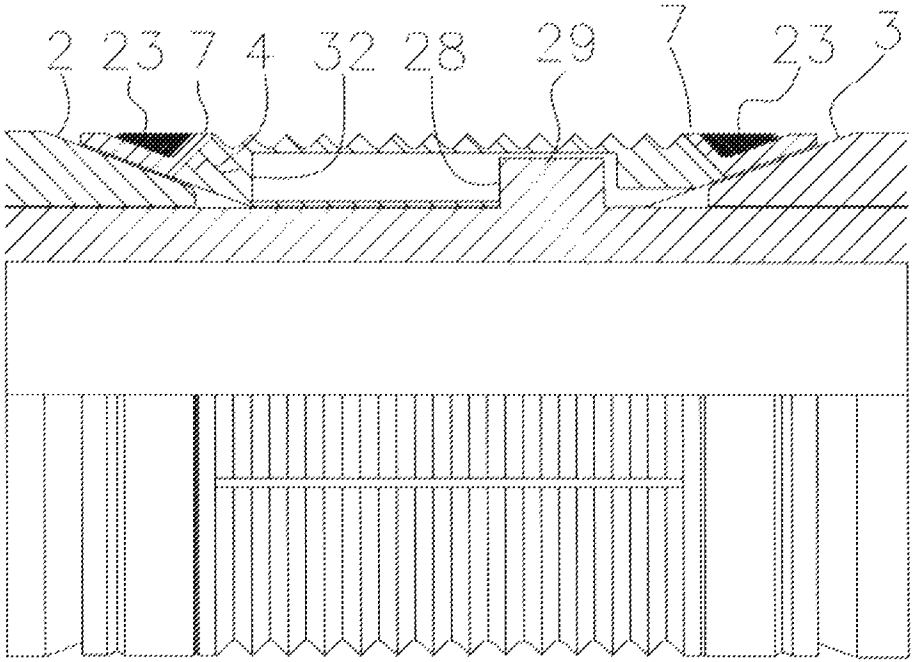
FIG. 4 is a close-up quarter-section view of the packer mandrel lugs inside of a slip segment pocket in the "running position".

FIG. 3 shows a cross-sectional view of the mandrel 1 and the slip segments 4. Notice that lugs are protruding from the mandrel as indicated by the arrow labeled 1 and surface 28. The lugs also have ears 29 that fit into the pockets 30. The pockets 30 are shaped to allow the slip segments to move from the "run position" to the "set position" and back again. When the ears 29 touch surface 33, the slip segments are trapped and can not expand further. This is a modification of the rotational lock pins 12 that are positioned between the slip segments. In this case some length, maybe 2 inches maximum, needs to be added to the slip segments. This configuration would apply more to a retrievable type packer where it is desired to retain the slips during retrieval. Referencing FIG. 4, the mandrel lugs 1 are shown in a cross-sectional longitudinal view. During packer retrieval, lug surface 28 contacts slip segment surface 32 and pulls slip segment 4 off cone surface 3. Of course, upper cone surface 2 is configured to move upward, when connected to a retrieving tool, from cone surface 3 to allow retraction of slip segment 4. Simultaneously, the inner surface of ear 29 of the lug 28, engages a lip 44 on the inside of the slip segment to retain the slip segment.

Figure 5:
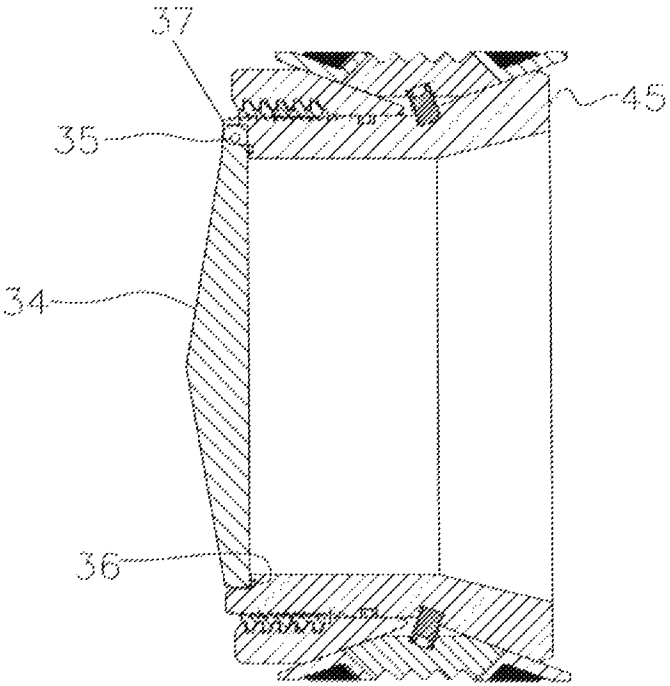
FIG. 5 is a schematic of the present invention with a "flapper valve" attached.

FIG. 5 shows a cross-section of the packer with the frangible disc removed from the bottom. Instead, a flapper valve 34 has been added to the top end of the packer. The flapper is hinged with pin 35 and seal on mandrel 45 at seal 36. This configuration would allow treatment of the well above the packer and flow of the well from below at a later time without removing any flow barriers.

Figure 6:
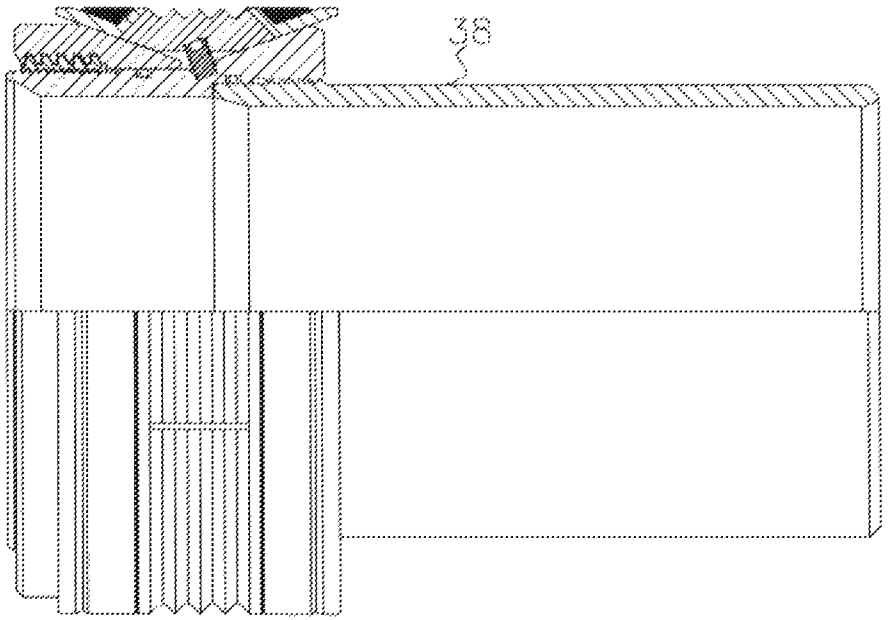
FIG. 6 is a schematic of the present invention with a "seal bore" attached.

FIG. 6 shows the packer modified to be a seal bore packer. Seal bore 38 has been added to create a production packer that would allow installation of a production string (not shown). Seals (not shown) on the end of the production string are placed in the seal bore to direct fluid up the production string.

Figure 7:
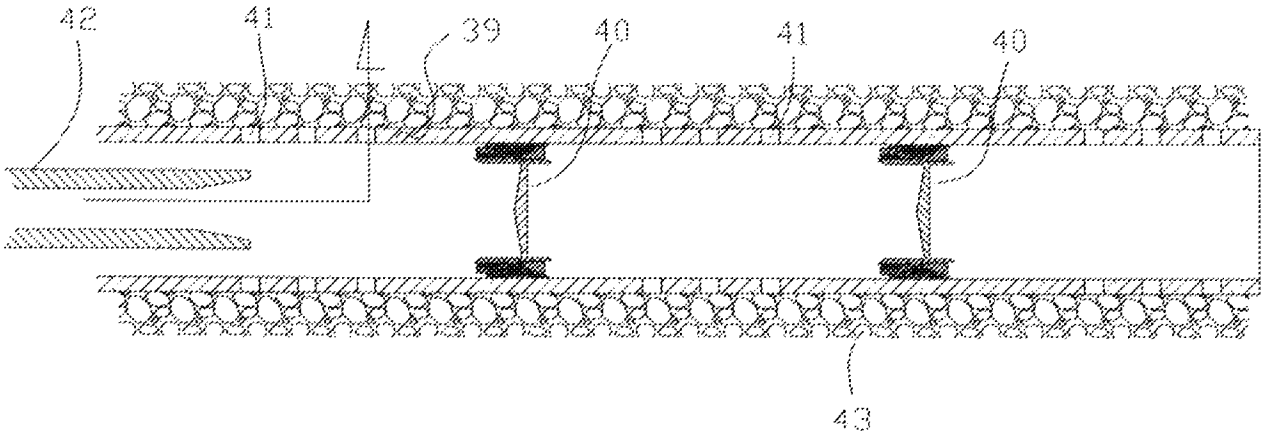
FIG. 7 shows two examples of the present invention in the "set position" inside of a section of casing with a workstring placing fluid into the formation above a set packer.

FIG. 7 shows well casing 39 in a formation 43. The well casing 39 has two sets of perforations 41 and two packers 40 positioned between the perforations. A work string 42 places fluid, acid or proppant, into the formation. The packer 40 forces the fluid into the formation. Every time a zone is treated, a packer can be set, the formation treated, and then go to another zone up the hole if desired. When all zones are treated, the packers can be milled out prior to production. If milling is not desired, the frangible disc or flapper packer configuration can be used.

Figure 8:
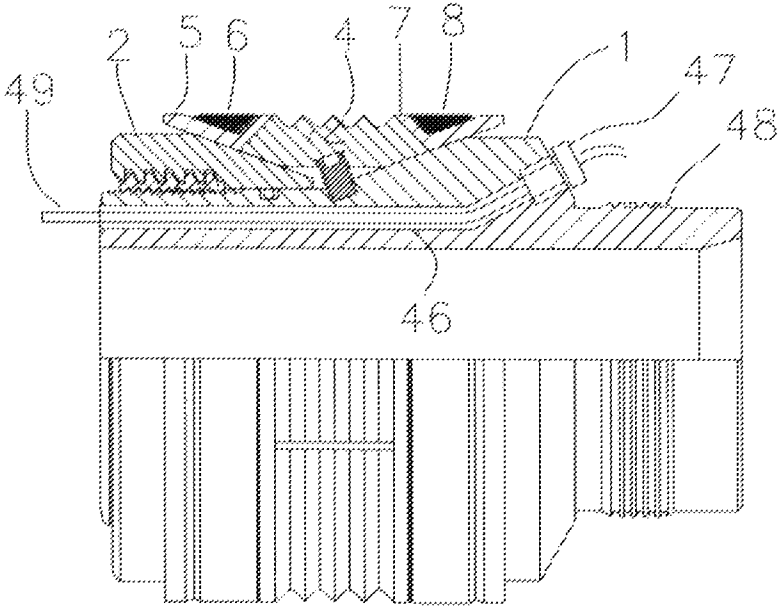
FIG. 8 shows a schematic of the present invention with a control line pass-thru added.

FIG. 8 shows the packer modified to serve as a "pass-thru" packer. The compact geometry of the slip and seal system reduces the length required to create a control line bypass through the body of the packer. This short distance can eliminate the expensive gun drill process that is usually needed to drill long holes through long packer bodies. FIG. 8 shows the same slip, seal and cone parts as in FIG. 1. Drilled hole 46 provides a path for the control line, or fiber optic or electrical line to pass through the packer body. Fitting 47 acts as a fluid barrier between the hole 46 and the control line 47. Thread 48 would be a typical connection on the packer to allow connection with the completion string (not shown). The top end of the packer is not shown for this example, but the top end of the packer would have some type of setting mechanism to stroke the packer to the set position.

Although the invention has been described above in terms of presently preferred embodiments, those skilled in the art of design and operation of subterranean well packers and the like will readily appreciate modifications can be made without departing from the spirit of the description and the appended claims, below. Accordingly, such modifications can be considered to be included within the scope of the invention disclosure and the claims.

What is claimed and desired to be secured by Letters Patent is:

1. A packer device for a well comprising:

a) a mandrel having a central flow passage, b) an axially movably upper cone member having a cone surface, c) a lower cone surface on an outer surface of the mandrel, d) a plurality of slip segments positioned on the mandrel between the upper cone member and the lower cone surface on the mandrel, e) a shear recess on a surface of the mandrel located below a top portion of the upper cone member prior to setting the packer such that when the packer device is set within the well, the upper cone member is moved to a position downhole of the shear recess so as to be supported by the mandrel when a portion of the mandrel uphole of the shear recess is removed during the setting process.

2. A packer device according to claim 1 further including a plurality of upper seals positioned between the slip elements and the axially movable upper cone member.

3. A packer device according to claim 2 further including a plurality of lower seals positioned between the slip elements and the lower cone surface on the outer surface of the mandrel.

4. A packer device according to claim 3 wherein the axially movable upper cone member includes internal threads that engage a body lock ring, the body lock ring surrounding an uphole portion of the mandrel.

5. A packer device according to claim 1 further including a frangible disc within the mandrel and blocking the central flow passage.

6. A packer device for a well comprising:

a) a mandrel having a shear recess on a surface thereof and a central flow passage, b) the mandrel having an uphole portion on the uphole side of the shear recess and a downhole portion on the downhole side of the shear recess, c) an axially movable upper cone member overlaying at least a portion of the uphole portion of the mandrel when the packer device is in a run-in position within the well, d) a cone surface located around the downhole portion of the mandrel, e) a plurality of slip elements positioned around the mandrel between the axially moveable cone member and the cone surface, whereby when the packer device is in a set position, the axially movable upper cone member is supported on the downhole portion of the mandrel and the uphole portion of the mandrel is removed.

7. A packer for a well according to claim 6 further including a plurality of upper seals positioned between the slip elements and the axially movable upper cone member.

8. A packer device for a well according to claim 7 further including a plurality of lower seals positioned between the slip elements and the cone surface.

9. A packer device as claimed in claim 6 further including a frangible disc within the mandrel and blocking the central flow passage.

* * * * *